US008544763B2

(12) United States Patent
Thel

(10) Patent No.: US 8,544,763 B2
(45) Date of Patent: Oct. 1, 2013

(54) PREFABRICATED PLINTH FOR SUPPORTING A RAILWAY TRACK

(75) Inventor: Antoni Bogdan Thel, Epsom, NH (US)

(73) Assignees: Concrete Systems Inc., Hudson, NH (US); John Walking Raven Kirk, Vashon, WA (US); Stephen C. Redmond, Bainbridge Island, WA (US)

( * ) Notice: Subject to any disclaimer, the term of this patent is extended or adjusted under 35 U.S.C. 154(b) by 205 days.

(21) Appl. No.: 12/985,767

(22) Filed: Jan. 6, 2011

(65) Prior Publication Data

US 2011/0220730 A1 Sep. 15, 2011

Related U.S. Application Data

(60) Provisional application No. 61/313,879, filed on Mar. 15, 2010.

(51) Int. Cl.
*E01B 3/00* (2006.01)

(52) U.S. Cl.
USPC ..... 238/115; 238/117

(58) Field of Classification Search
USPC ..... 238/109, 111, 115, 116, 117
See application file for complete search history.

(56) References Cited

U.S. PATENT DOCUMENTS

| | | | | | |
|---|---|---|---|---|---|
| 990,650 | A * | 4/1911 | Hayes | 238/117 |
| 1,251,339 | A * | 12/1917 | Carroll | 238/115 |
| 1,622,259 | A * | 3/1927 | Lipham | 238/115 |
| 1,704,545 | A * | 3/1929 | Petterson | 238/26 |
| 2,658,688 | A * | 11/1953 | Trylinski, Sr. et al. | 238/115 |
| 3,190,607 | A * | 6/1965 | Sonneville | 249/91 |
| 3,223,328 | A * | 12/1965 | Moses et al. | 238/25 |
| 3,300,140 | A * | 1/1967 | Moses et al. | 238/25 |
| 3,371,866 | A * | 3/1968 | Sonneville | 238/58 |
| 4,198,798 | A | 4/1980 | Haydock | |
| 4,216,904 | A * | 8/1980 | Vivion | 238/25 |
| 4,232,822 | A * | 11/1980 | Hahn et al. | 238/7 |
| 4,802,623 | A * | 2/1989 | Fasterding et al. | 238/44 |
| 5,404,689 | A * | 4/1995 | DiNarda | 52/699 |
| 5,887,788 | A * | 3/1999 | Wakui et al. | 238/81 |
| 6,435,496 | B1 * | 8/2002 | Phillips | 269/94 |
| 6,488,215 | B2 * | 12/2002 | Mohr | 238/2 |
| 7,063,269 | B2 * | 6/2006 | Molyneux | 238/287 |
| 7,198,200 | B2 * | 4/2007 | Kowalski | 238/115 |
| 2004/0065746 | A1 * | 4/2004 | Schwarzbich | 238/287 |
| 2004/0084548 | A1 * | 5/2004 | Schwarzbich | 238/310 |
| 2004/0231286 | A1 * | 11/2004 | Alton et al. | 52/790.1 |
| 2005/0252985 | A1 * | 11/2005 | Braithwaite | 238/105 |

(Continued)

OTHER PUBLICATIONS http://www.lbfoster.com/Rail/trackwork.html, L.B. Foster Rail Products, "Trackwork", Feb. 24, 2010, 1 page.

*Primary Examiner* — Jason C Smith
(74) *Attorney, Agent, or Firm* — Fay Sharpe LLP

(57) ABSTRACT

A precast plinth for supporting an associated object, such as a rail of a railway track, includes an elongated body made of a material including concrete. The plinth includes an upper face, a lower face, a first side face, a second side face and first and second end faces. The first and second side faces taper away from each other from the upper face to the lower face. A leveling hole can extend from the upper face to the lower face with a threaded leveling insert located in the leveling hole. A grout hole can extend from the upper face to a lower face in a spaced manner from the leveling hole.

14 Claims, 10 Drawing Sheets

PERSPECTIVE VIEW - PLINTH COMPONENTS

(56) References Cited

U.S. PATENT DOCUMENTS

2006/0150556 A1* 7/2006 Powell ..... 52/561
2010/0243752 A1* 9/2010 Bosterling et al. ..... 238/349
2010/0308122 A1* 12/2010 Freudenstein et al. ..... 238/115
2011/0168796 A1* 7/2011 Laurello et al. ..... 238/310

* cited by examiner

PERSPECTIVE VIEW - TYPICAL PLINTH INSTALLATION

PLAN VIEW – PRECAST PLINTH

TYPICAL PRECAST PLINTH
WITHOUT MOUNTING AND FASTENING COMPONENTS

PERSPECTIVE VIEW - PLINTH COMPONENTS

TYPICAL PLINTH WITH ALL COMPONENTS

SECTION A–A

SECTION B–B

SECTION C–C

TANGENT TRACK SECTION

CURVED – SUPERELEVATED TRACK SECTION

PREFABRICATED PLINTH FOR SUPPORTING A RAILWAY TRACK

The instant application is a full utility application of and claims priority from U.S. Provisional Application Ser. No. 61/313,879 which was filed on Mar. 15, 2010, said application being incorporated by reference in its entirety.

BACKGROUND OF THE DISCLOSURE

The present disclosure relates to plinths for supporting a railway track or the like. More particularly, the disclosure is directed towards precast concrete plinths which sit on a mortar or grout bed sandwiched between the bottom of the plinth and the top of a support structure or track bed.

A plinth is defined in architecture as a block or slab upon which an item to be supported is mounted. The item could be a column, a sculpture or the like. In the present disclosure, the plinth is employed to support a railway track of the type employed by transit systems on which a train or a trolley runs.

In recent years, the overcrowding and congestion of metropolitan areas has resulted in an increasing demand for mass transit rail systems. With tight municipal budget constraints, less expensive methods for constructing railway tracks are needed to reduce costs for municipalities and transit systems. Currently, the steel rail of a transit rail system sits on concrete plinth bases that are cast in place with forms. This is less than desirable, as the construction site is an inefficient and expensive setting for the manufacture of the plinths. A need exists for a more efficient method of constructing and installing plinths for supporting railway tracks and the like.

BRIEF SUMMARY OF THE DISCLOSURE

According to one embodiment of the present disclosure, a precast plinth is provided for supporting an associated object. The plinth comprises an elongated body comprising a concrete material and including an upper face, a lower face, a first side face and a second side face and first and second end faces. The first and second side faces taper away from each other from the upper face of the elongated body to the lower face thereof.

According to another embodiment of the present disclosure, a series of precast plinths are provided, which are generally aligned along a longitudinal axis for supporting an associated railway track. Each plinth comprises a generally rectangular body including an upper face and a lower face. A leveling hole extends from the upper face to the lower face. A threaded leveling insert is located in the leveling hole. The insert cooperates with an associated leveling screw that selectively extends in the leveling hole. A grout hole extends from the upper face of the body to the lower face thereof. The grout hole is spaced from the leveling hole.

In accordance with still another embodiment of the present disclosure, a plinth assembly is provided for supporting an associated rail. The plinth assembly comprises an elongated body including an upper face, a lower face and first and second end faces. At least one leveling hole extends in the elongated body from the upper face to the lower face. A leveling insert is located in the at least one leveling hole. The leveling insert cooperates with an associated leveling fastener which selectively extends in the leveling hole to allow the plinth assembly to be level in relation to a subjacent support surface.

In accordance with a further embodiment of the present disclosure, a method is provided for installing a rail supporting member. The method comprises placing a plinth on a support surface, and leveling the plinth in relation to the support surface. A grout is applied between the plinth and the support surface and is allowed to set. Holes are then drilled into the support surface at predefined locations on the plinth. A fastener is positioned in each hole. The fasteners are secured to the plinth and to the support surface. Each accessible opening in the plinth is then sealed with a grout material.

BRIEF DESCRIPTION OF THE DRAWINGS

The disclosure may take physical form in certain parts and arrangements of parts, preferred embodiments of which will be described in detail in this specification and illustrated in the accompanying drawings which form a part hereof and wherein.

DETAILED DESCRIPTION

It should, of course, be understood that the description and drawings herein are merely illustrative and that various modifications and changes can be made in the structures disclosed without departing from the spirit of the present disclosure. It will also be appreciated that the various identified components of the plinth installation disclosed herein are merely terms of art that may vary from one manufacturer to another and should not be deemed to limit the present disclosure.

Figure 1:
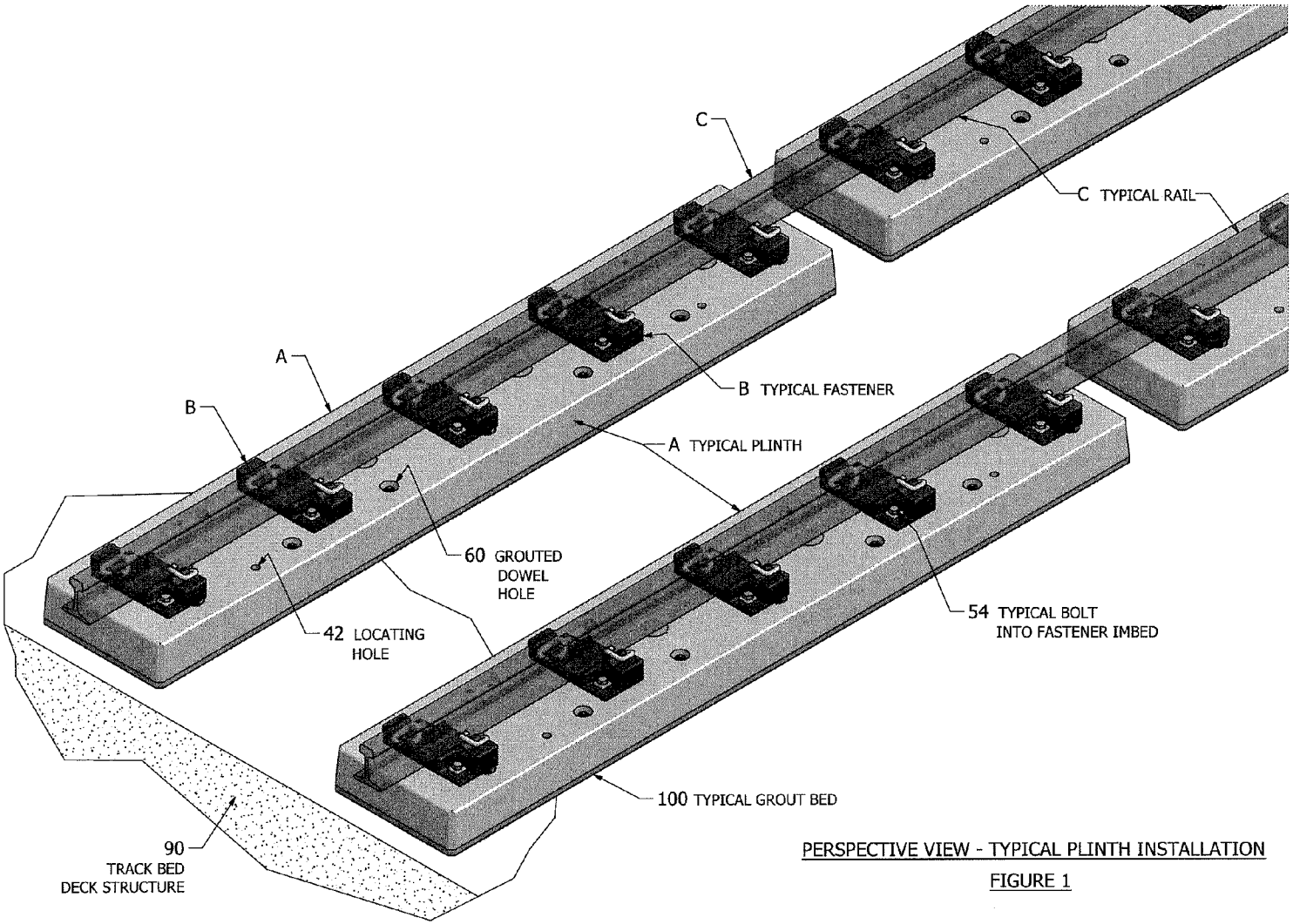
FIG. 1 is a perspective view illustrating several plinths according to the present disclosure mounted on a track bed and supporting a pair of railway rails.

Referring now to the drawings, wherein the showings are for purposes of illustrating several embodiments of the present disclosure and not for purposes of limiting same, FIG. 1 shows a plinth installation according to the present disclosure. The installation includes several plinths A on which are mounted a plurality of rail fasteners B which themselves hold rail sections C of a railway track. With reference now to FIG. 2A, a plinth A includes a body 10 which has a top face 12, a bottom face 14 (see FIG. 3), a first side face 16 and a second side face 18 (see FIG. 3), as well as first and second end faces 20 and 22. The plinth may be made from a suitable known concrete material and precast in a factory employing a mold assembly so that identical plinths of consistent quality can be manufactured to precise tolerances in a controlled factory setting. Thus, a precision engineered product is manufactured, which product is designed to provide maximum strength, durability and ease of installation.

Figure 4:
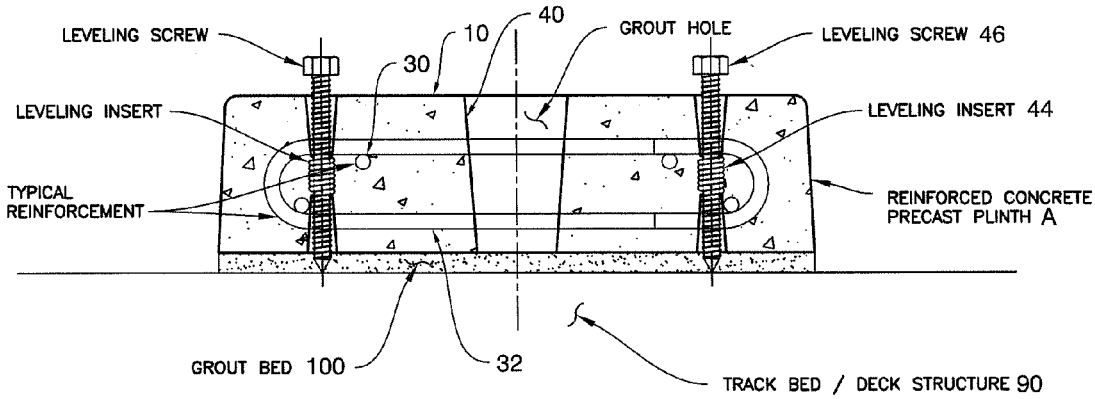
FIG. 4 is an enlarged cross-sectional view of the plinth of FIG. 2 along line B-B thereof.

In one embodiment, the material can be a high strength concrete, such as concrete which has a compressive strength of at least 5000 psi. With reference now also to FIG. 4, the concrete can be reinforced with suitable known reinforcing materials. These include polymer fibers, carbon fibers, stainless steel rods, iron rods, or mesh materials made of metal, plastic or combinations thereof. In sum, any type of known reinforcement material, whether it is strand, fiber, rod or mesh, can be used. The concrete can either be pretensioned or post tensioned with such reinforcing materials. FIG. 4 illustrates reinforcing fibers 30 and 32 which are oriented transverse to each other and extend in at least a portion of the plinth body 10.

In one embodiment, the plinth can be approximately 15 feet long and 24 inches wide. The thickness of the plinth depends on the particular circumstances in which it is employed. If the rail carries heavier carriages or engines, the plinth may need to be thicker. Also, if curved track is supported, the thickness of the plinth may vary. In this regard, one can notice the difference in the thickness of two plinths illustrated in FIG. 7. Each plinth can weigh around 500-3,500 pounds. Precast plinths can be easily handled and installed.

It is noted that the sidewalls 16 and 18 of the plinth taper from the upper face 12 to the lower face 14. This is done so that the plinth, which is cast upside down in a factory, can be more easily removed from its mold. It is also noted that the upper edges of the face 12 are somewhat curved or rounded, as is illustrated, e.g., in FIG. 3.

Figure 2:
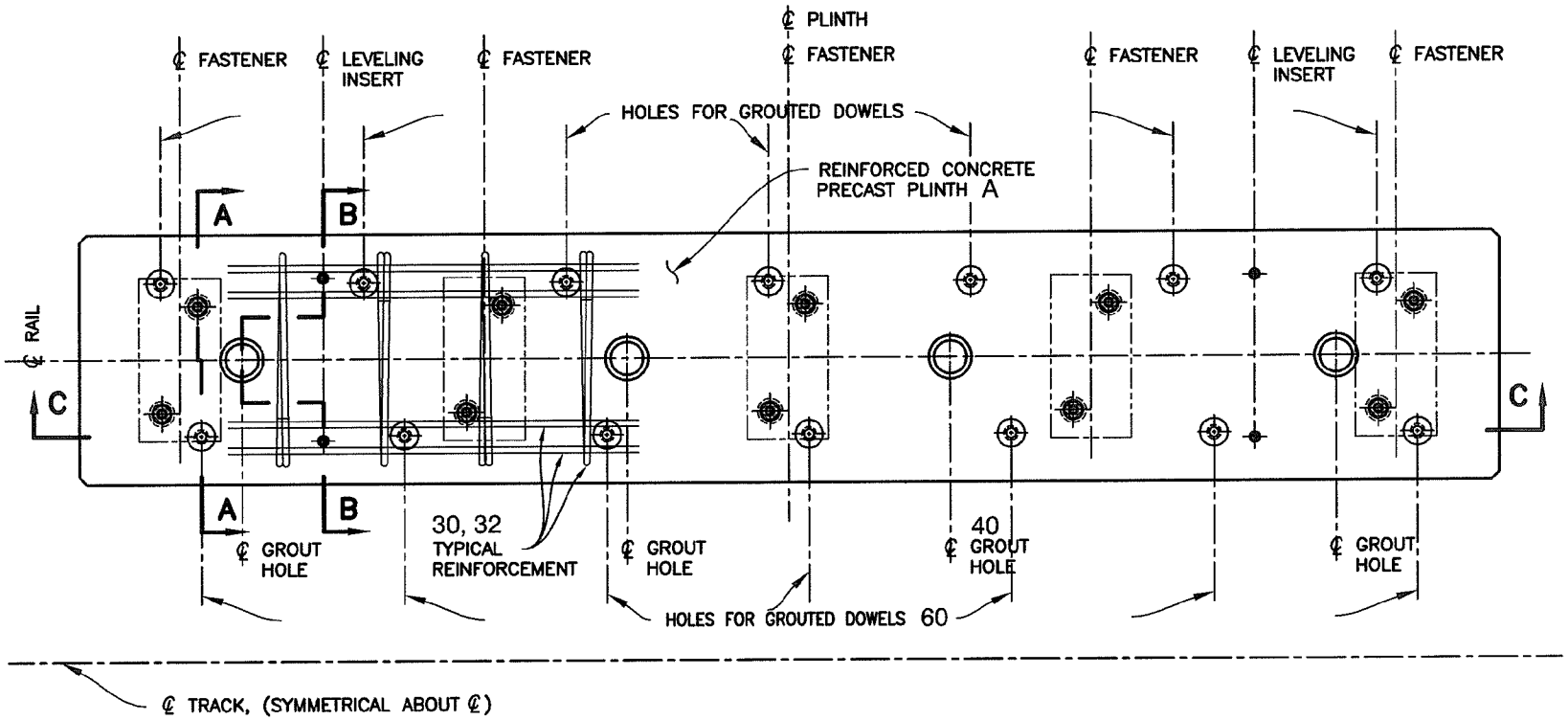
FIG. 2 is an enlarged top plan view of a plinth of FIG. 1.
Figure 2A:
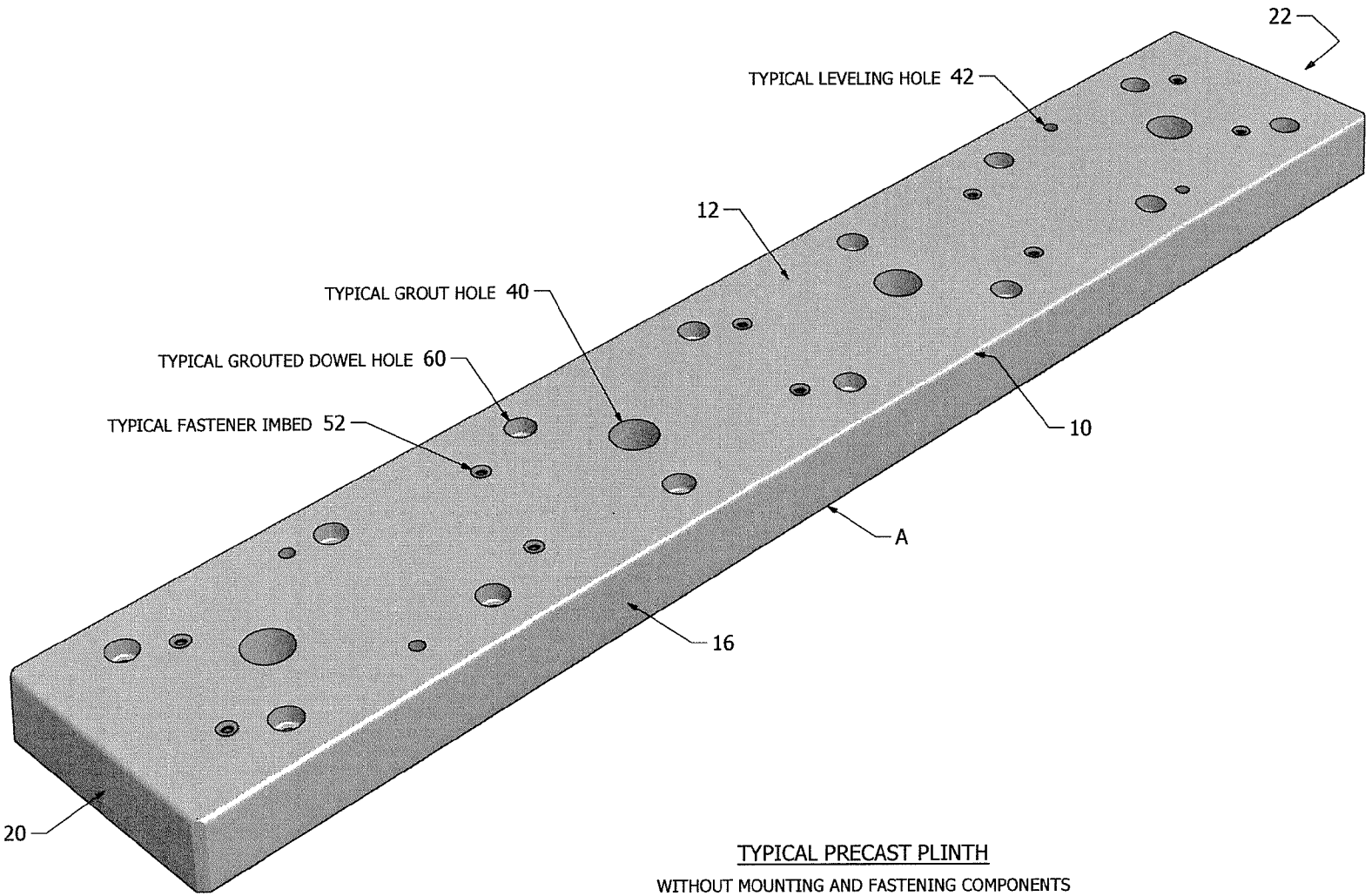
FIG. 2A is a perspective view of the plinth of FIG. 2 without mounting and fastening components.
Figure 3:
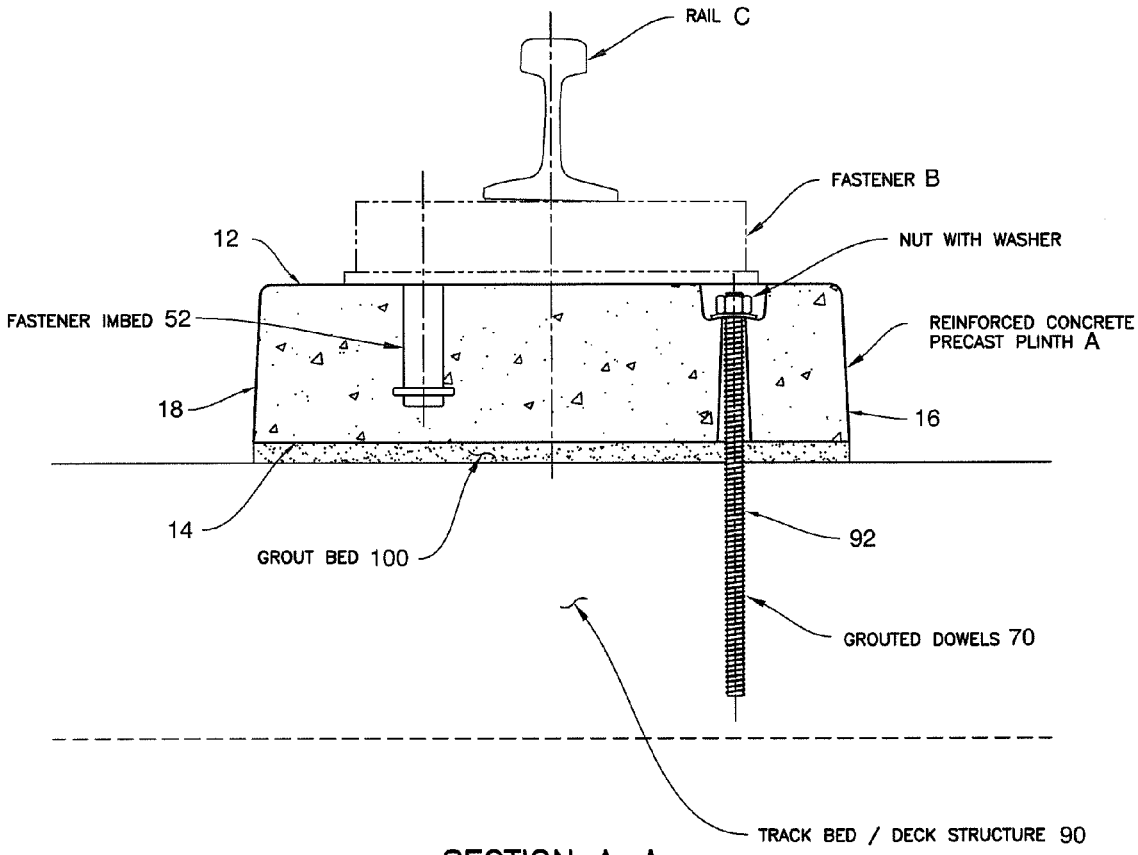
FIG. 3 is an enlarged cross-sectional view of the plinth of FIG. 2 along line A-A.

With reference now to FIG. 2, the plinth includes at least one grout hole 40. The one or more grout holes can be provided along a center line of the plinth A. Also provided are leveling holes 42 (FIG. 2A). With reference now also to FIG. 4, positioned in each leveling hole is a leveling insert or sleeve 44. The insert can be positioned roughly equidistantly between the plinth's upper face 12 and lower face 14. The leveling insert 44 comprises a threaded inner bore section which cooperates with a threaded outer periphery of a leveling screw 46 that is selectively threaded into the plinth body 10.

With reference now again to FIG. 3, the plinth also includes at least one fastener imbed 52. The imbed accommodates a fastener or bolt 54 that is illustrated in FIG. 2C. The surrounding concrete adheres the imbed 52 and creates a bond to retard a removal of the imbed from the plinth. It should be evident that a series of spaced imbeds 52 are provided along the length of the plinth. Similarly, a series of spaced grout holes 40 and leveling holes 42 is provided along the length of the plinth, as may be evident from, e.g., FIG. 2B of the drawings.

Figure 5:
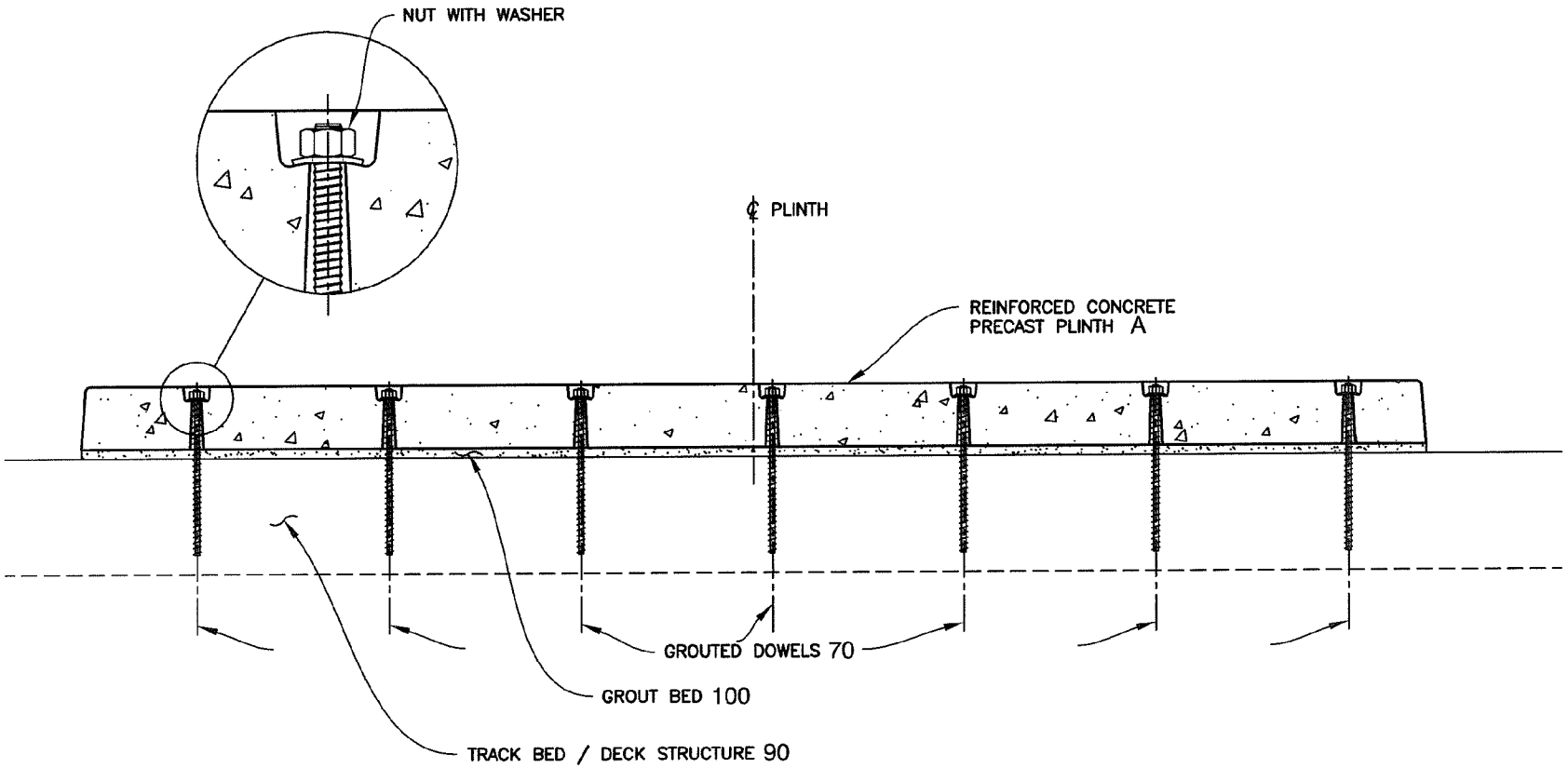
FIG. 5 is a side elevational view of the plinth of FIG. 2 along line C-C thereof.
Figure 5A:
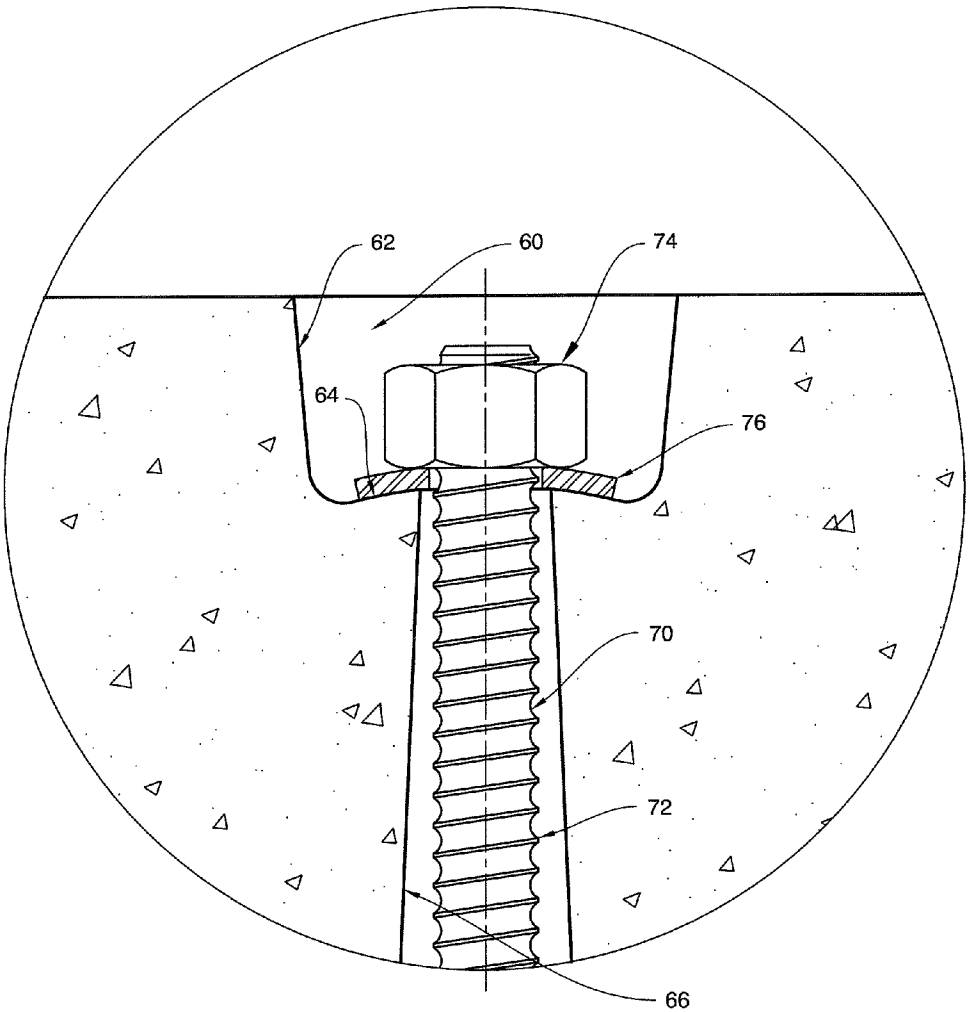
FIG. 5A is a greatly enlarged view of a portion of the plinth of FIG. 5.
Figure 6:
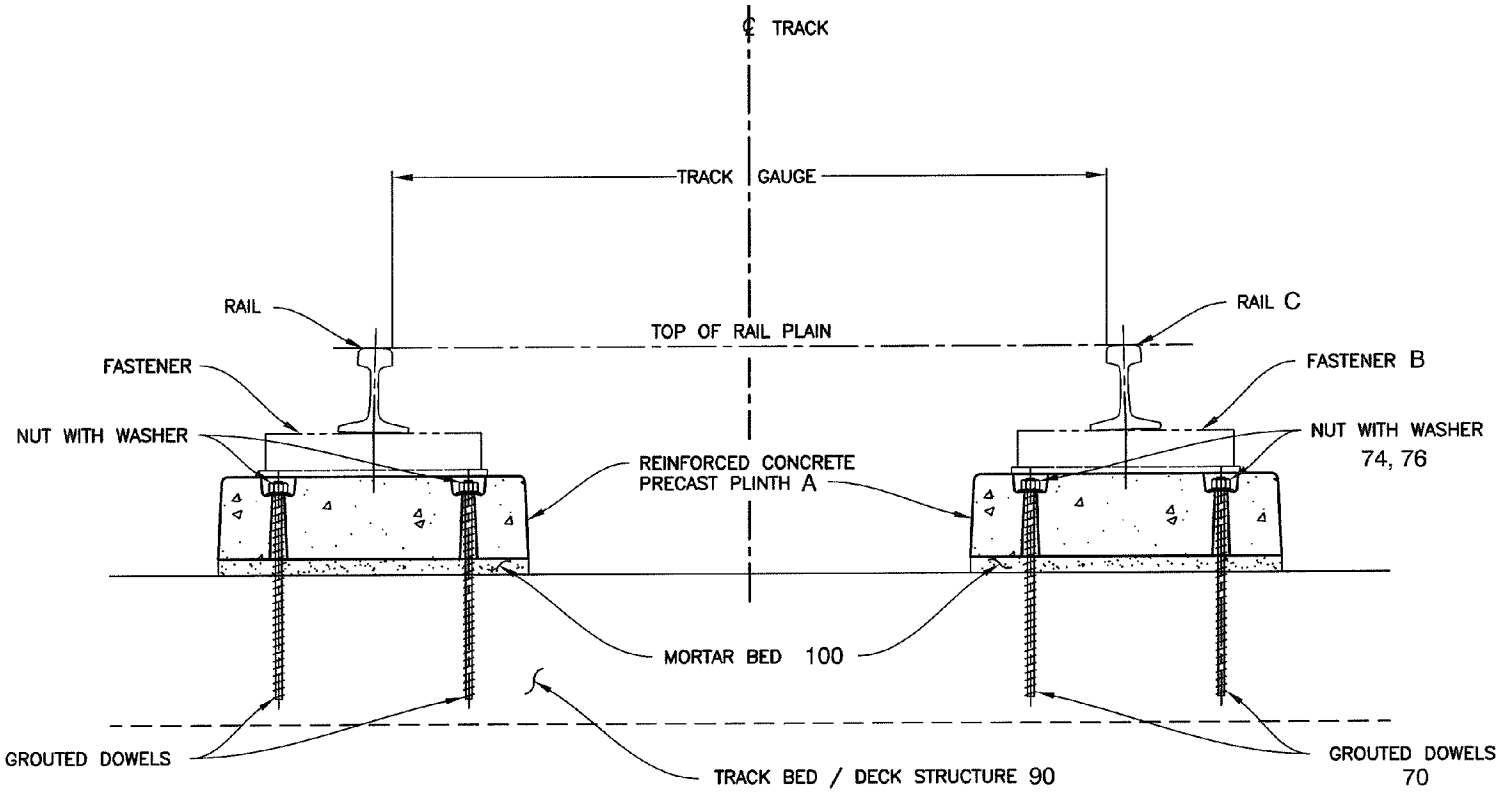
FIG. 6 is an end elevational view in section of the plinth installation of FIG. 1; and, FIG. 7 is an end elevational view in section of a super elevated track in accordance with another embodiment of the present disclosure.

Further provided in the plinth body 10 are one or more fastener holes 60 for accommodating associated fasteners. With reference now to FIG. 5A, each hole includes an upper bore portion or section 62 of a relatively large diameter which terminates in a shoulder 64 and leads to a lower bore portion or section 66 of a relatively small diameter. However, it is noted that the whole lower portion 66 can be tapered from the shoulder 64 to the second face 14 of the plinth body. In other words, the diameter of the lower bore portion 66 can be larger at the second face than it is adjacent the shoulder 64. Various holes can be tapered in different ways, as can be noted from a comparison of the holes in FIGS. 3 and 4.

A dowel, anchor rod or fastener 70 can extend through the dowel hole 60. As is evident from FIGS. 5 and 5A, the dowel includes a threaded portion 72. The dowel can be made from a suitable metal material such as a steel bar and can be of high strength. Selectively fastened to the threaded portion 72, adjacent one end of it, is a nut 74. The nut is seated in the hole upper portion 62, and is threaded to a location adjacent the shoulder 64. Trapped between the nut and the shoulder 64 is a washer 76. It is noted that the washer can be somewhat convex in shape, so as to match a complementary convex shape of the shoulder 64 defined in the plinth body. In other words, both the washer 76 and the shoulder 64 are somewhat convex in shape. The convex shape of the washer is beneficial in distributing the force applied by the nut 74 onto the shoulder 64 in order to prevent any cracking or fracture of the concrete material of the shoulder 64. The nut will create a lock with the plinth to post tension the plinth to the track bed 90, as may be evident from FIG. 5. The convex washer 76 assures uniform torque of the nut 74 and can achieve up to 6,000 lbs of post tensioned torque per anchor rod, fastener, or dowel 70.

The plinth is supported on a track bed or deck structure 90. To this end, apertures 92 are drilled into the track bed so that the dowels 70 which can extend through the dowel holes 60 in the plinth can extend into the track bed. In this way, the plinth body 10 is secured in place on the track bed 90. A grout bed 100 is positioned between the plinth A and the track bed 90. While a grout is discussed herein, it should be evident that any known type of mortar or the like crack filling material can be employed for this purpose. Generally, the grout has the same ingredients as concrete, but it has a fluidity or plasticity which is far greater than conventional concrete. The purpose for grout is to completely fill the grout space and the joint between concrete members in order to provide a solid homogenous grouted concrete structure. It is the fluidity of the grout which allows it to flow through the grout space and bond to the track bed 90, as well as the plinth body 10. The excess water, which is a placement vehicle for the grout and helps it flow between the plinth bottom face 14 and the track bed 90, is absorbed by one or both of the plinth and the track bed. Thus, the final water/cement ratio of the grout is reduced to a point where the strength of the hardened grout is in accordance with the specification called for.

As mentioned, the plinths are precast in a manufacturing facility, in a controlled factory environment, and are then delivered to the work site to be secured in place on a subjacent support surface, such as the track bed 90, which can be made of concrete. The plinths are designed to be easily handled and transported from a precast factory to a construction site for fast and precise installation. As is evident from FIG. 1, there can be gaps or spaces between adjacent longitudinally aligned plinths. These gaps can be on the order of 6-15 inches.

The precast plinth disclosed herein can be employed with any deck structure and is used for supporting direct fixation track sections. For example, it can be used with precast tunnel sections or segments, as well as in a variety of other ways. Precast plinths can be used for supporting various types of tracks, such as tangent tracks, curved tracks, superelevated tracks and guarded tracks.

The process for installing the plinths will now be discussed. First, the track bed 90 is cleaned so that it is free of any protrusions, oil products or the like. Once the area is surveyed and the location for the plinth to be installed is identified, the plinth is brought into position on a support surface using a conventional lifting device. The plinth is then set and leveled in relation to the support surface using the leveling screws 46. In other words, the leveling screws 46 are used to set the plinth at the proper height, in relation to predetermined survey lines, and to precision tolerances, prior to grouting the plinth in place. The grout is delivered through the one or more grout holes 40 located in each plinth. In order to prevent the grout from flowing away, wood boards or the grout dams can be employed to keep the grout confined between the track bed or deck structure and the plinth bottom face 14 until the grout sets. Subsequently, the wood boards can be removed.

Once the grout has set, the leveling screws are removed. In this way, they can be reused when the next plinth is placed on the track bed. A non-shrinking grout is employed for the grout bed 100. An accelerant can be added to the grout, as can a bonding agent, so as to provide a quick setting grout that adheres tenaciously to both the plinth and the track bed or deck structure. The grout, which can include epoxy resin, is a known product and is widely available from a large number of vendors in the U.S.

Figure 2B:
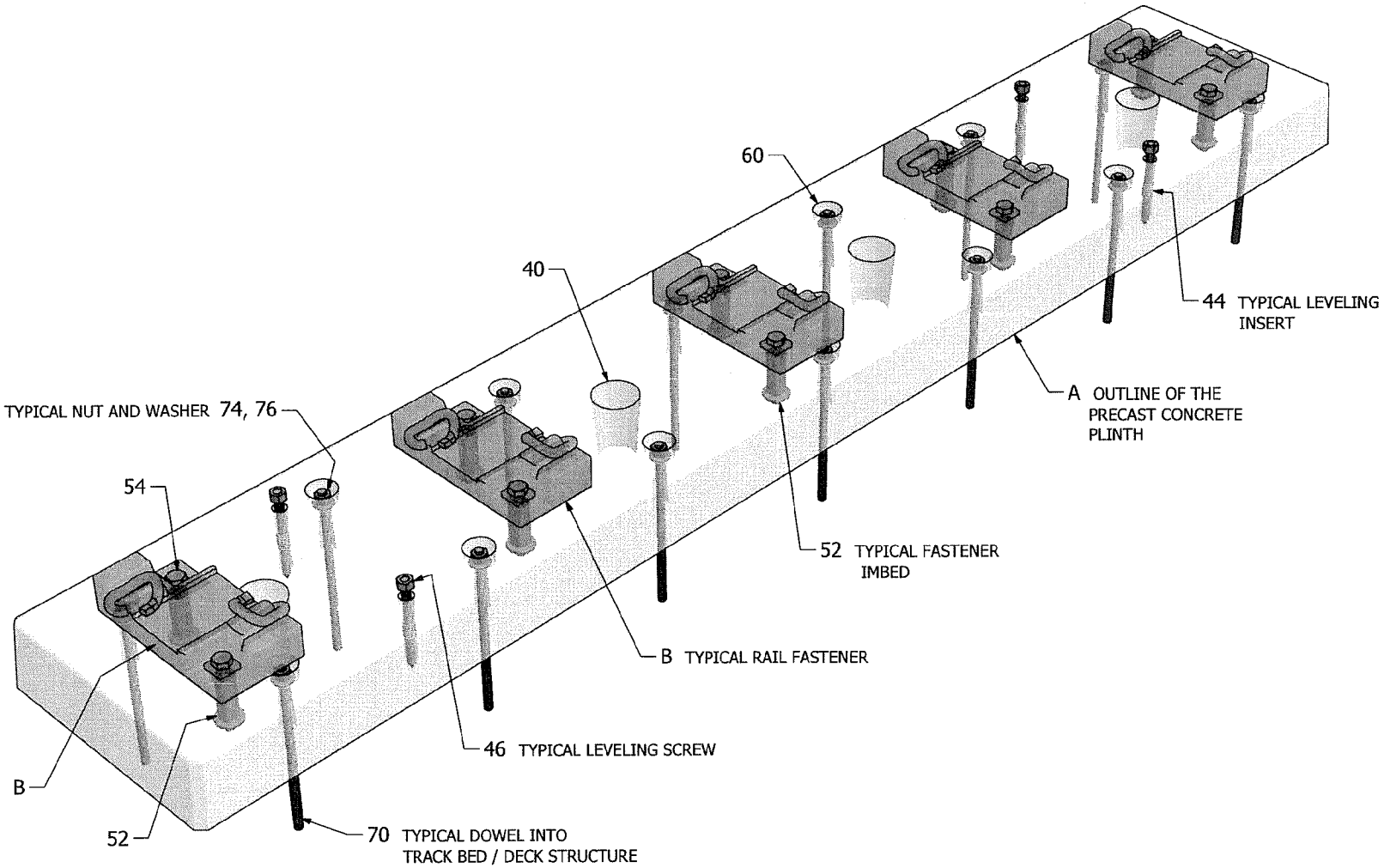
FIG. 2B is a perspective view of certain mounting and fastening components shown in correct location on the plinth of FIG. 2.
Figure 2C:
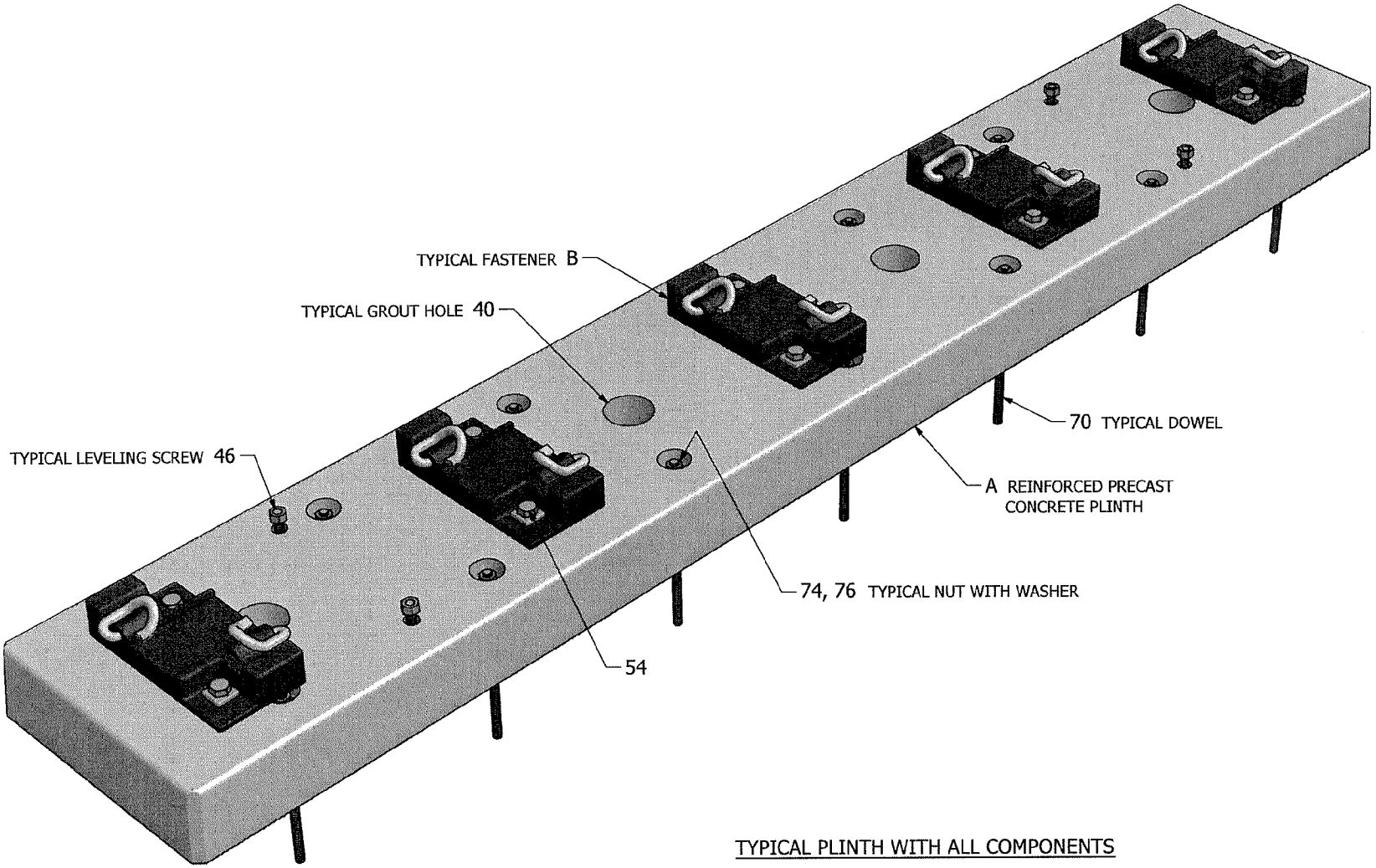
FIG. 2C is a perspective view of the plinth of FIG. 2 with all components.

Thereafter, the track bed or deck is drilled at the predefined locations of the dowel holes 60 located in the plinth A, as illustrated in, e.g., FIG. 2B. The holes are then cleaned and vacuumed. The dowels 70 are then placed in the dowel holes 60. Once the washers 76 and nuts 74 have been correctly placed and the nuts tightened to the desired degree, additional grout is employed to secure the dowels 70 in place. The curing of this grout can take approximately an hour. The dowels can be a cast malleable iron material, steel, or any other desired suitable material. Bonding agents and accelerants can be added to the additional grout material in order to enhance its curing rate, as well as its gripping power to the deck structure 90, the plinth body 10 and the dowels 70. As mentioned, tensioning is applied to the plinth by the use of the nuts and washers 74 and 76, as best shown in FIG. 5A. The nut is tightened on the dowel enough so that approximately 10 psi of compression force is developed upon post tensioning of the plinth to the bed. Thus, the nut creates a lock with the plinth. Each dowel 70 is embedded deep enough into the track bed that it is unlikely to pull out. For example, the dowel can be embedded by about 10 inches into the track bed. The several dowels are meant to be embedded at a constant depth into the track bed.

If there are fourteen dowels or bolts in use, in one embodiment disclosed herein, there can be developed up to 50,000 pounds of compression force on the plinth.

Once the nuts are tightened to the desired degree and no further movement of the nuts is necessary, the dowel hole upper portion 62 can be filled with an epoxy grout or the like. This is done in order to seal the nut in place at the desired tension. Thereafter, the rail hardware, including the fastener B is mounted to the top face 12 of the plinth, employing fasteners threaded into the fastener imbeds 52. Thereafter, the rail C is positioned on the fasteners and secured in place.

Figure 7:
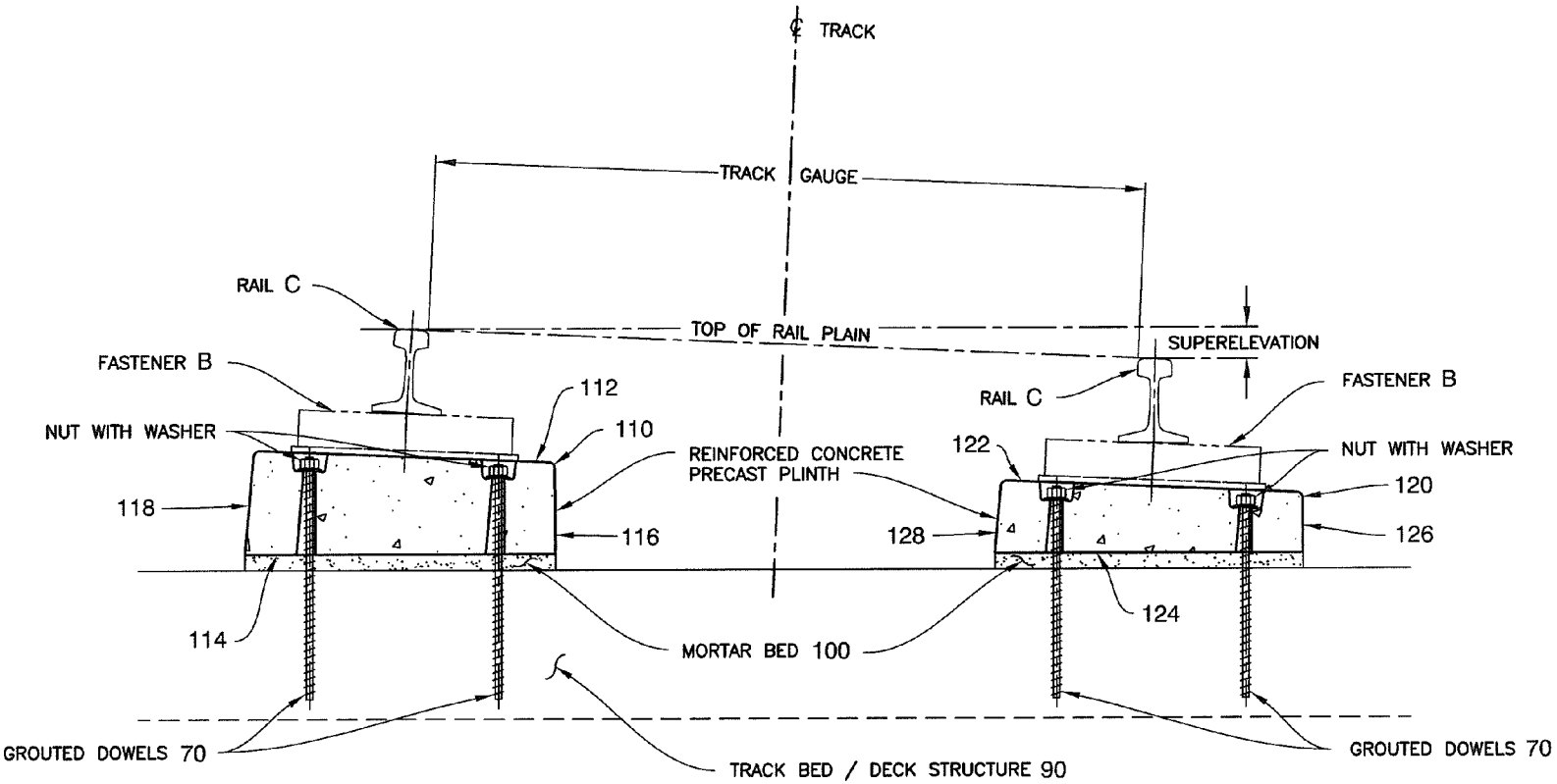

It is important to recognize that the dowels are always oriented perpendicular to the track bed. For example, FIG. 7 illustrates that the dowels 70 can be angled in relation to the upper and lower surfaces 12 and 14 of the plinth body. It is for this reason that the dowel hole lower portion 66 is tapered.

What has been discussed previously is the precast plinth arrangement in the case of a straight track, with no superelevation. FIG. 7 shows the precast plinth arrangement in the case of a curved and superelevated track. In this regard, FIG. 7 illustrates a plinth body 110 which includes a top surface 112, a bottom surface 114 and first and second side faces 116 and 118. It should be evident that the top face 112 is not parallel to the bottom face 114, as was the case with the plinth 10 illustrated in, e.g., FIG. 3. Rather, the top face 112 is angled in relation to the bottom face 114. A similar construction is illustrated for the plinth body 120 which includes a top face 122 that is canted in relation to the bottom face 124. In other words, the plinth body 110 is tapered in this embodiment from its second side face 118 towards its first side face 116. It is also noted that the plinth body 110 is thicker than is the plinth body 120. This allows the rails C supported by each of the plinth bodies 110 and 120 to be at different elevations in relation to each other. This, in turn, allows the track to be curved. However, the grouted dowels 70 are oriented perpendicular to the horizontal plane of the track bed 90.

It is important to recognize that creep of the concrete of the plinth and the grout between the plinths and the track bed or structure 90 can occur because of the post tensioning of the bolts and, hence, the plinth. There can be up to 4,000 pounds of push towards the bed. Creep is a long term permanent deformation of the material of both the concrete of the plinth and of the grout or mortar bed. It is beneficial to reduce such creep as much as possible.

With precast plinths according to the instant disclosure, installation of track can continue in any season or during any type of weather condition, saving both time and money. Also, as a result of the plinths being precast, the inaccuracies of cast-in-place plinths are eliminated. The lengthy periods of waiting for concrete to cure, foul weather, and the need for expensive "re-do's" are minimized. The plinths can be custom designed and fabricated for tangent or superelevated sections of the track. Moreover, the plinths can be delivered to the construction site with bar coding on them for foolproof placement and complete with all materials and hardware necessary for installation. It is estimated that precast plinths can be installed at least twice as fast as conventional poured-in-place equivalents, and at greatly reduced project labor cost.

The present disclosure has been described with reference to the several embodiments shown. Obviously, modifications and alterations will occur to others upon the reading and understanding of the preceding detailed description. It is intended that the present disclosure be construed as including all such modifications and alterations insofar as they come within the scope of the appended claims or the equivalents thereof.

The invention claimed is:

1. A precast plinth for supporting an associated object, comprising:

an elongated body comprising a concrete material and including an upper face, a lower face, a first side face and a second side face and first and second end faces, wherein said first and second side faces taper away from each other from said upper face to said lower face;

a grout hole extending from said upper face to said lower face;

a fastener hole extending from said upper face to said lower face, said fastener hole being spaced from said grout hole;

a leveling hole extending in said elongated body from said upper face to said lower face, said leveling hole being spaced from said grout hole and said fastener hole; and a leveling insert located in said leveling hole, said insert cooperating with an associated leveling fastener that selectively extends in said leveling hole.

2. The plinth of claim 1 wherein a plurality of grout holes and fastener holes are spaced along said elongated body.

3. The plinth of claim 2 wherein said plurality of grout holes extend along a longitudinal axis of said elongated body and said plurality of fastener holes are spaced away from said longitudinal axis.

4. The plinth of claim 1 further comprising a fastener imbed mounted to said body, in a spaced manner from said grout hole and said fastener hole.

5. The plinth of claim 1 wherein said fastener hole includes a shoulder having a convex shape for accommodating an associated washer of complementary shape.

6. The plinth of claim 1 wherein said body upper face is oriented parallel to said body lower face.

7. A plinth assembly including a series of spaced precast plinths generally aligned along a longitudinal axis for supporting an associated railway track, each plinth comprising:

a generally rectangular body including an upper face and a lower face;

a leveling hole extending from said upper face to said lower face;

a threaded leveling insert located in said leveling hole, said insert cooperating with an associated leveling screw that selectively extends in said leveling hole; and, a grout hole extending from said upper face to said lower face, said grout hole being spaced from said leveling hole.

8. The plinth assembly of claim 7 further comprising:

a fastener hole extending from said upper face to said lower face, said fastener hole being spaced from said leveling hole and said grout hole and accommodating a fastener for connecting said body to an underlying support structure.

9. The plinth assembly of claim 8 wherein said fastener hole includes an upper bore section of a first diameter, a shoulder and a lower bore section including at least a portion of a second smaller diameter.

10. The plinth assembly of claim 9 further comprising a nut selectively connectible to said fastener for tensioning said body.

11. The plinth assembly of claim 10 further comprising a washer positioned between said nut and said shoulder.

12. A plinth assembly for supporting an associated rail, comprising:

an elongated body including an upper face, a lower face, and first and second end faces;

at least one leveling hole extending in said elongated body from said upper face to said lower face; and a leveling insert located in said at least one leveling hole, said leveling insert cooperating with an associated leveling fastener which selectively extends in said leveling hole to allow the plinth assembly to be leveled in relation to a subjacent support surface.

13. The plinth assembly of claim 12 further comprising at least one fastener hole spaced from said at least one leveling hole, said at least one fastener hole comprising:

a first bore section;

a shoulder; and a second bore section separated by said shoulder from said first bore section, wherein said shoulder has a somewhat convex shape for accommodating an associated washer of complementary shape.

14. The plinth assembly of claim 12 further comprising at least one fastener imbed located in said body, said at least one fastener imbed being spaced from said at least one leveling hole.

* * * * *